United States Patent [19]

Buza et al.

[11] Patent Number: 4,997,098

[45] Date of Patent: Mar. 5, 1991

[54] BAIL EAR FOR PLASTIC CONTAINER

[75] Inventors: Imre J. Buza, South Euclid; Terry L. Hartman, Solon, both of Ohio

[73] Assignee: Cardinal Packaging, Inc., Streetsboro, Ohio

[21] Appl. No.: 410,668

[22] Filed: Sep. 21, 1989

[51] Int. Cl.[5] ..... B65D 25/32

[52] U.S. Cl. ..... 220/91

[58] Field of Search ..... 220/91, 92, 95, 96

[56] References Cited

U.S. PATENT DOCUMENTS

| | | | |
|---|---|---|---|
| B 349,141 | 1/1975 | Frankenberg | 220/91 X |
| 1,126,658 | 1/1915 | Roughton | 220/96 |
| 1,358,385 | 11/1920 | Molthan | 220/95 |
| 1,883,823 | 10/1932 | Renshaw | 220/91 |
| 2,176,711 | 10/1939 | Gorman, Jr. | 221/91 |
| 2,851,187 | 9/1958 | Hall | 220/91 |
| 2,921,730 | 1/1960 | Brebner . | |
| 3,341,107 | 9/1967 | Poupitch . | |
| 3,425,471 | 2/1969 | Yates, Jr. | 220/91 X |
| 3,550,807 | 12/1970 | Yates, Jr. | 220/91 |
| 3,595,431 | 7/1971 | Bird | 220/90 |
| 4,215,789 | 8/1980 | Pfeifer | 220/96 |
| 4,227,623 | 10/1980 | Woinarski | 220/91 |
| 4,643,325 | 2/1987 | Streit | 220/91 |

FOREIGN PATENT DOCUMENTS

| | | | |
|---|---|---|---|
| 832359 | 4/1960 | United Kingdom | 220/91 |

*Primary Examiner*—Stephen Marcus

*Attorney, Agent, or Firm*—Fay, Sharpe, Beall, Fagan, Minnich & McKee

[57] ABSTRACT

A plastic pail having a continuous side wall and a radially extending rim includes a pair of diametrically opposed bail ears which receive a bail. The bail ears are of a box-like configuration and extend outwardly from the side wall and downwardly from the rim. An outer face of the bail ear has an aperture through which the bail is received. A plurality of connecting walls join the outer face with the side wall, and an arcuate configuration joins the connecting walls to the side wall. The bail includes an elongated gripping portion with a pair of diverging side portions extending therefrom. A pair of connectors defined by arcs having a circumferential extent greater than 180° is joined to the respective side portions by substantially parallel end portions.

18 Claims, 2 Drawing Sheets

BAIL EAR FOR PLASTIC CONTAINER

BACKGROUND OF THE INVENTION

This invention pertains generally to the art of plastic pails and more particularly to plastic pails having metal bail-type handles. The invention is particularly applicable to plastic pails which are subjected to loads or forces at low or freezing temperatures, and will be described with particular reference thereto. However, it will be appreciated that the invention has broader and more general application, and may be advantageously employed in other environments.

Plastic pails of the type to which this invention pertains ordinarily include metal bails that are joined to the pail by means of pliable bail ears or lug members. These metal bails are often wire-like and are bent or formed into a variety of configurations. These configurations are typically governed by either the intended use of the pail or the manner in which the pail is manufactured or assembled.

Of particular interest in the present case are those pails which have integrally molded bail ears of box-like configuration, with an outer face or bail receiving wall of each bail ear having an aperture or bail connection location through which an end of the bail is received. Although these pliable bail ears function adequately at room temperatures, the plastic from which they and the pail are molded sometimes becomes brittle at low temperatures. Because the pails are often used to store frozen food products such as ice cream, it is not uncommon for them to be exposed to prolonged freezing temperatures. When, as a consequence of such low temperature exposure, the plastic becomes frozen and brittle, many configurations of metal bails can cause a rupture or fracture in the outer face of the bail ear, which then allows the bail end to extend further inwardly to puncture a hole through the pail wall. Bits of plastic can then fall into the pail interior and contaminate the food product contained therein. In order to prevent such food contamination, and further to maintain a relatively durable pail, it is desirable to develop a bail ear that offers greater rigidity than the bail ears of the prior art, but to do so without incurring the costs of changing the chemical composition of the plastic from which the combination is molded, or extensively modifying the manner in which the bail end is joined with the bail ear. It is also desirable to develop a corresponding bail member which is not likely to break through the pail wall, while at the same time having such a configuration to allow for ease of manufacturing and assembly of the finished pail product.

In the past, many attempts have been made to overcome the problems described above, and provide an integrally molded plastic bail ear which would prevent a metal bail from puncturing through a plastic pail side wall at low temperatures. For example, integrally molded bail ears of the prior art have included a plurality of rigid support walls extending from an outer surface of a pail wall. Such walls were generally parallel with each other, and extended substantially perpendicularly from the outer wall of the pail. That is, each of the support walls substantially defined a right angle with the pail wall.

There were problems with this attempt. First, when the bail ear was formed so that only two rigid support walls were molded therewith, the bail handle continued to break though the pail wall at low temperatures. As a result, plastic pieces fell into the pail and contaminated any frozen food products stored therein.

Second, when the number of integral walls was increased to four, the two additional walls were positioned parallel to, but inward of, the first two connecting walls. It was intended that any forces applied to the bail ear would be spread along a large area of the pail wall outer surface. The problem with adding walls was that the bail did not have enough space to freely rotate. The vertical length of the additional walls was shortened to accommodate the bail ear, but the bail ear continued to rupture in response to loads at low temperatures. When the bail ears were exposed to low temperatures, the rigid support walls failed to provide adequate support for the bail ear. The right angles defined by the individual support walls and pail wall provided weak, brittle stress areas susceptible to breakage. For instance, when the bail ears discussed above were forced inward toward the pail as a result of high lateral loads, or simply as a result of carrying the pail by the bail, the bail ears tended to break at their weakest points. The bail was thus able to puncture its way through the pail wall and contaminate any pail contents.

Bails of a variety of configurations were used in association with many of the above-discussed bail ears. For instance, bails having knobs at their extreme terminal ends were used. These, however, readily punctured through the pail walls in response to laterally applied forces. Bails with simple J-shaped ends were also used, but these, too, readily pierced through the pail wall. Further attempts at improving the bail included placing a plurality of bends in the bail, both near and at the terminal ends, as well as along the main body of the bail. The presence of these bends provided problems because the pails were difficult to assemble. Not only was it difficult to position the bail in the bail ear, but bails bent along their body portions were easily caught in the assembly machinery. Moreover, many bails of the prior art were configured so that it was difficult to pivotally move them within the bail ears.

The present invention contemplates a new and improved arrangement which overcomes all of the above described problems and provides a rigid bail ear for receipt of a metal bail on a plastic pail. The rigid bail ear of the invention is integrally molded with the pail and provides an economical means for protecting the pail wall from rupture, and for preventing contamination of food or other contaminants contained within the pail. The improvement allows the chemical composition of the prior art pail to remain unchanged, and also greatly reduces the likelihood of bail ear or pail fracture when the pail is exposed to forces at low temperatures. The invention further provides a bail member having a suitable configuration for use in association with the bail ear of the present invention. The configuration reduces the likelihood of the bail piercing through the pail side wall. It also is suitable for ease of pail manufacturing and assembly.

BRIEF DESCRIPTION OF THE INVENTION

In accordance with the present invention, there is provided an improved bail ear or lug means for receiving and joining a bail to a plastic pail or container. The bail ear or lug means of the invention is integrally molded with the pail. It includes a bail receiving wall or outer face spaced outwardly from the pail wall, but joined thereto by a radially extending pail rim as well as a plurality of connecting walls.

In accordance with a more limited aspect of the invention, there is provided a plastic pail or container including a bottom wall, a side wall, and a radially extending rim located adjacent an upper end of the side wall. A bail is joined to the pail by at least one lug means. The lug means is integrally molded with the pail and comprises a box-like structure which projects outwardly from the side wall and downwardly from the rim. The box-like structure has an outer support wall which receives the end of the bail. The support wall is generally parallel to the pail side wall, and is joined thereto by parallel and vertically extending connecting walls which are positioned at the ends of the support wall. A plurality of generally merging arcuate configurations are defined by the intersections of each of the connecting walls with the pail side wall. These arcuate configurations absorb the stress placed on the bail ears by outside forces. The bail is pivotally received by the lug means and includes an elongated gripping portion with a pair of opposed side portions diverging from extreme ends of the gripping portion. The bail further includes a pair of connectors joined to but spaced from said side portions by a pair of parallel end portions. The connectors are defined by arcs having a circumferential extent greater than 180°. It is unlikely that the arcuate portions of the bail ears will collapse or fail in response to forces or loads at low temperatures. It is also unlikely that the bail member of the present invention will pierce through the pail side wall.

As is apparent, a primary advantage of the invention is that the improved lug means or bail ear has a new configuration which absorbs stress or forces that are placed on the bail ear. The new configuration prevents the bail ear from breaking at the stress points, i.e., the right angle turns which are apparent in the prior art. As a result, the pail wall is less likely to rupture.

Another advantage of the present invention is that by reducing the possibility of pail rupture in light of the arcuate surfaces, there is less possibility of contaminating the pail contents with bits of plastic.

Another advantage of the present invention is that the bail member configuration provides a bail that is unlikely to pierce through the pail side wall.

Another advantage of the present invention is that the bail member configuration is one that provides for ease of pail assembly.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENT

Figure 1:
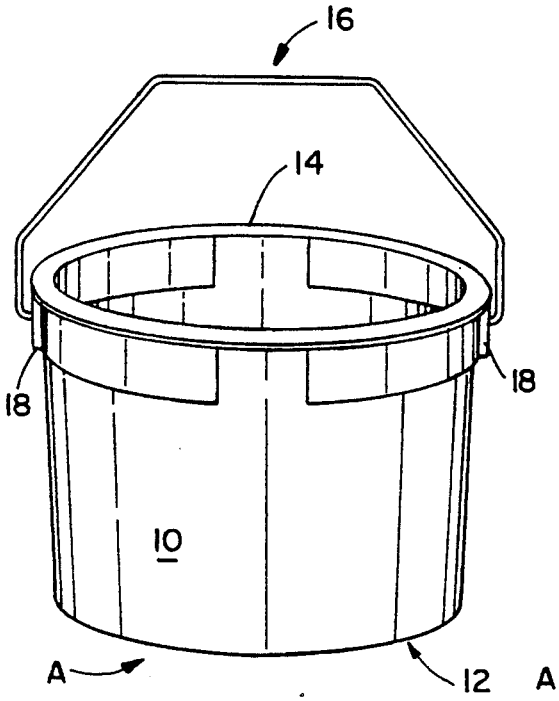
FIG. 1 is a perspective view of a pail having a bail and bail ears.
Figure 2:
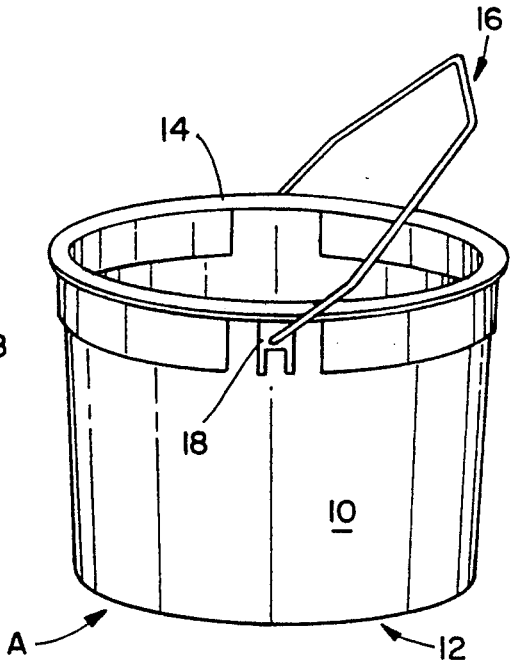
FIG. 2 is a perspective view of the pail having a bail and bail ears.

Referring now to the drawings wherein the showings are for the purposes of illustrating the preferred embodiments of the invention only and not for the purposes of limiting same, FIGS. 1 and 2 illustrate a pail or container A injection molded from a plastic such as high density polyethylene, and having a generally cylindrical configuration. The pail includes a side wall 10 that is integrally joined with a bottom wall 12. The side wall extends up from the bottom wall and terminates in a radially extending rim 14 which is located at an upper end of side wall 10. As will be appreciated, the rim 14 acts to provide lateral strength and rigidity to side wall 10.

An improved wire bail member 16 is joined to the pail at an upper end thereof by diametrically opposed lug means or bail ears 18. The bail ears 18 are integrally molded with the pail and extend outwardly from the pail side wall from an outer surface thereof, and downwardly from the radially extending rim 14. They are diametrically opposed in order to provide balance when the container or pail is carried by bail means 16. The bail ears or lug means 18 are formed adjacent the upper edge of the side wall, and receive the ends of the bail member. As discussed above in the Background of the Invention section, problems have been encountered because in the past bail member ends have punctured through the side walls of pails at freezing temperatures. The plastic from which the pail is molded becomes brittle at low temperatures. When the frozen pail is subjected to high lateral loads, the bail is likely to puncture a hole through the pail wall. This problem can be overcome with the bail ears or lug means of the present invention alone or with the bail configuration shown in FIG. 7.

Figure 4:
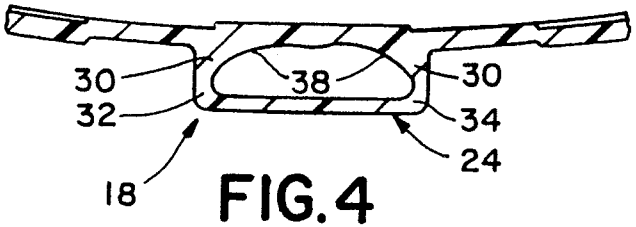
FIG. 4 is a cross-sectional view taken generally along line 4—4 of FIG. 3.
Figure 3:
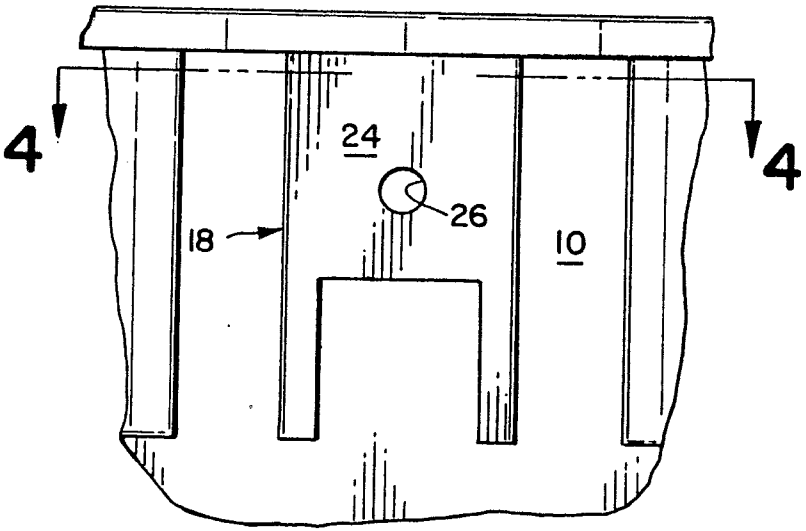
FIG. 3 is an elevational view of a bail ear.

Referring in particular to FIGS. 3 and 4, and with continuing reference to FIGS. 1 and 2, it will be noted that lug means 18 of the subject invention are located in diametrically opposed positions on the pail and are integrally molded with the main body of the pail. Broadly, the lug means each has a box-like shape and includes an outer or bail receiving wall 24 which is generally parallel to the side wall !0 and integrally joins at its upper edge with radially extending rim 14. Preferably, as best seen in FIG. 3, the bail wall 24 includes or defines a bail receiving aperture 26 through which a connecting portion of bail 16 extends. The end of bail 16 can be of a simple "J" configuration, or it can have a knob-like portion at the end thereof. Preferably, the connector portion of bail 16 will have the configuration shown in FIG. 7. It is preferred that the bail receiving aperture 26 be of circular configuration as shown in FIG. 3. It is conceivable, however, that the aperture could be polygonal or elliptical in shape as well.

In accordance with the subject invention, the bail receiving wall 24 of the lug means 18 is supported by a plurality of connecting walls or flanges 30 which extend outwardly from the side wall 10 to the bail receiving wall 24. Specifically, a first connecting wall 32 and a second connecting wall 34 are molded integrally with the side wall of the pail and are connected at their upper end to the underside of rim 14. The connecting walls or flanges 30 are joined to one another by the outer or bail receiving wall 24 which is integrally molded therewith. Walls 32 and 34 extend vertically in parallel relationship, and are substantially perpendicular with pail wall 10.

As is particularly apparent in FIG. 4, each of the walls 30 extend outwardly from pail side wall 10. The intersection between each wall 30 and the pail side wall 10 defines a generally merging, arcuately configured, eased corner, or radial corner 38. The purpose of these curved corners 38 is to absorb any stress applied to the bail ears from lateral forces, or simply from the force which results from normal use or carrying of the pail, particularly at low or freezing temperatures. Although FIG. 4 shows the radial corners 38 along inner surfaces or interior positions of the bail ear, the radial corners form rounded bends which could also be situated on outer surfaces of the bail ear. It is foreseeable that the radial corners could be positioned only on the outer surface of the ear, or on both the inner and outer surfaces. FIG. 4 shows the bail ear having eased corners located along inner surfaces of the ear and positioned so they are in a facing relationship with each other.

The connecting walls 30, together with the bail receiving wall 24 and the pail side wall 10, define a void 40 inside of the bail ear 18. Void 40 is sufficiently large to permit a connector portion of bail member 16 to freely rotate within the opening or aperture 26 without engaging connecting walls 30 or pail side wall 10. Furthermore, no part of the bail member engages the arcuate corners 38. The outer or bail receiving wall 24 is removed from the pail side wall a distance defined with the connecting walls 30.

Because of the generally arcuate merging configuration defined by the individual intersections of the side wall and connecting walls, the forces exerted by the ends of the bail are dampened by such curved portions. These portions significantly reduce the likelihood of rupture of bail ear 18 or pail wall 10, especially at low or freezing temperatures.

Figure 7:
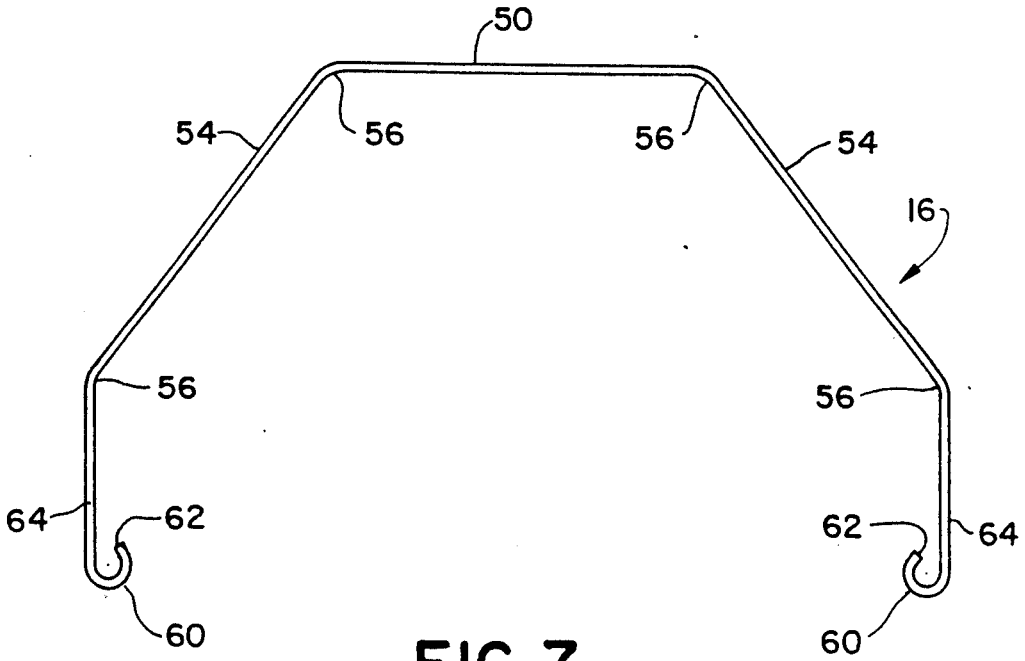

Turning now to FIG. 7, the bail 16 is disclosed. It is advantageous to use the bail configuration shown in FIG. 7 in association with the plastic pail or container A shown in FIGS. 1 and 2. The bail member 16 is essentially a continuous wire-like metal member and is divided into portions. A linear handle or gripping portion 50 is centrally located on the bail, and, when the pail is in standard upright position, the gripping portion 50 is essentially parallel with the p pail bottom wall 12 when the pail is completely assembled with the bail ear in place. The gripping portion 50 can be any number of lengths, but is generally of a length sufficient for a person to comfortably hold and carry the pail by wrapping his or her fingers therearound. A pair of linear side portions 54 divergingly extend from terminal ends of the gripping portion 50. The length of the side portion is substantially equal to that of the gripping portion, and the intersection between the individual side portions and the gripping portion is shown in FIG. 7 to be a radial or eased corner 56. Of course, it is possible that a sharper, more definite angled intersection could replace the eased corners 56.

Connectors 60 are shown at distal or free ends 62 of the bail member. These connectors have an arcuate configuration which extends beyond 180°. Because the radius of the connector is greater than 180°, the connector can easily fit in the void or space 40 defined by the bail ear 18. The outer diameter of the connector portion 60 is such that the connector can freely pivot within the bail ear. The curvature of the connector keeps the bail from extending a distance that would allow the bail to pierce through the pail side wall 10. The connectors 60 are joined to the side portions 54 of bail 16 linear by end portions 64 at additional eased corners 56. These end portions 64 are shown to be substantially parallel with one another and are diametrically opposed when the bail is assembled to the pail A. It is, of course, possible that the end portions could be situated at either inwardly or outwardly angled relative to the plane of the pail side wall. The end walls are situated a suitable distance apart so that the entire bail can freely rotate about the rim 14, as is evident from FIGS. 1 and 2.

As discussed above, the shape of the bail member is one which allows for ease of assembly of plastic pails containing metal bails. The shape of the connectors is such that they are not likely to puncture through the pail wall at low or freezing temperatures. Moreover, the connectors are not so large that they cannot freely rotate in the bail ear. The connectors 60 may have a slight rearward or forward twist to them, or they can be completely planar with the remaining portions of the bail 16. The metal bail of FIG. 7 when used with the bail ear 18 of the present invention, will be likely to provide a pail that is unlikely to rupture at low or freezing temperatures.

Figure 6:
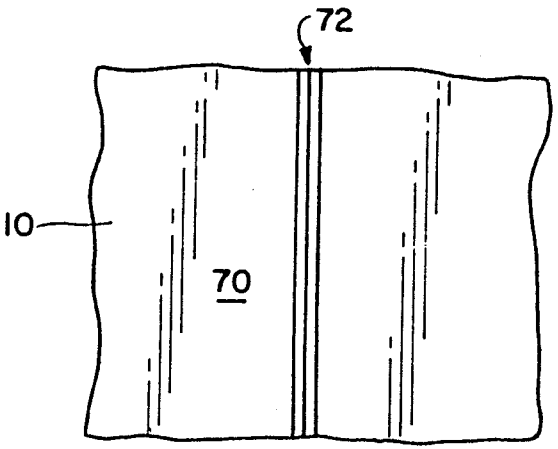
FIG. 6 is a broken away view of an interior surface of a pail wall of the second embodiment, the view taken generally along line 6—6 of FIG. 5; and, FIG. 7 is an elevational view of a bail.
Figure 5:
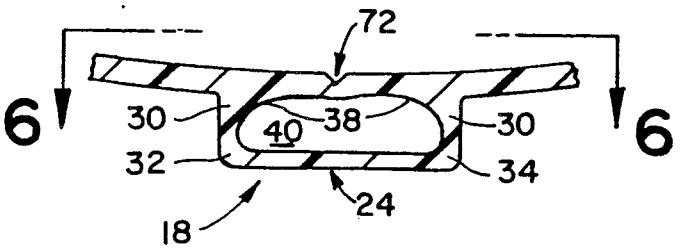
FIG. 5 is a cross-sectional view of a second embodiment of a bail ear joined to a pail wall.

FIGS. 5 and 6 disclose an alternative embodiment of the present invention. According to this embodiment, an interior surface 70 of pail side wall 10 defines a recess or notch 72 in close proximity to the position of each bail ear. The notch is shown as being substantially V-shaped, and extends vertically a distance approximately equal to the length of connecting walls 30. The notch 72 provides a controlled breakpoint. That is, the purpose of the notch is to supplement the radiused corners 38 in response to lateral forces applied to the bail ear. When pressure is applied to the side of the pail near the bail ear, the V-shaped opening 72 will adjust in an effort to relieve the force that is applied on the bail side wall. Accordingly, when the pail is subjected to low or freezing temperatures, the radiused corners 38 will serve to prevent the bail 16 from causing the bail ear to rupture in response to lateral loads or forces. Recess or notch 72 supplements the curved corner 72 in providing additional protection against the bail puncturing the pail side wall 10.

The invention been described with reference to the preferred embodiments. Obviously, modifications and alterations will occur to others upon a reading and understanding of the specification. It is my intention to include all such modifications and alterations insofar as they come within the scope of the appended claims or the equivalents thereof.

We claim:

1. A pail comprising:

a bottom wall;

a continuous side wall extending upwardly from said bottom wall and terminating in a radially extending rim;

a bail member; and, a first lug means for connecting a first end of said bail member to said pail, said lug means formed integrally with the side wall and having a box-like structure projecting outwardly from the side wall and downwardly from the rim, an outer wall of the box-like structure defining a bail-receiving aperture therethrough, the outer wall supported by a plurality of rigid and generally parallel connecting walls, an inner surface of each of the connecting walls increasing in thickness from a point closely adjacent said outer wall such that inwardly facing radial corners adjacent the side wall are provided, the radial corners terminating on the side wall substantially opposite the bail receiving aperture.

2. The pail of claim 1 wherein a second integrally molded lug means is situated diametrically opposite from the first lug means for connecting a second end of said bail member to said pail side wall.

3. The pail of claim 1 wherein the outer wall of the box-like structure is generally parallel to the side wall and positioned a distance therefrom which is determined by the width of the connecting walls.

4. The pail of claim 1 wherein the bail receiving aperture is circular in shape and generally located within the outer wall of the box-like structure.

5. A pail comprising:

a bottom wall;

a continuous side wall extending upwardly from said bottom wall and terminating in a radially extending rim;

a bail member; and, a first lug means for connecting a first end of said bail member to said pail, said lug means formed integrally with the side wall and having a box-like structure projecting outwardly from the side wall and downwardly from the rim, an outer wall of the box-like structure defining a bail-receiving aperture therethrough, the outer wall supported by a plurality of rigid and generally parallel connecting walls which join said outer wall to said side wall at eased corners, the side wall further including a recess on an interior surface thereof closely proximate the lug means to allow for the expansion and contraction of said wall.

6. The pail of claim 5 wherein the recess is defined by a substantially V-shaped notch, the notch providing a pressure relief when a force is applied to the pail side wall.

7. The pail of claim 5 wherein a second integrally molded lug means is situated diametrically opposite from the first lug means for connecting a second end of said bail member to said pail side wall.

8. The pail of claim 5 wherein the eased corners are located within an interior portion of the box-like structure.

9. The pail of claim 5 wherein the outer wall of the box-like structure is generally parallel to the side wall and positioned a distance therefrom which is determined by the width of the connecting walls.

10. The pail of claim 5 wherein the bail receiving aperture is circular in shape and generally located within the outer wall of the box-like structure.

11. A container comprising:

a bottom wall;

a continuous side wall extending from the bottom wall and terminating in a radially exending rim;

first and second bail ears, each of said bail ears integrally molded with the container and situated diametrically opposite one another on an outer surface of said container adjacent the rim, the ears defined by first and second radially extending flanges interconnected by a bail receiving member, the flanges defining first and second rounded bends at the pail side wall, an inner surface of the pail side wall defining at least one recess in close proximity to each bail ear to allow for the expansion and contraction of said wall; and, a wire-like bail member pivotally received by said bail ears, the bail member including an elongated gripping portion with a pair of opposed side portions diverging from extreme ends of the gripping portion, the bail member further including a pair of connectors spaced from said side portions by a pair of substantially parallel end portions, the connectors defined by arcs having a circumferential extent greater than 180° and terminating in a distal end.

12. The container of claim 11 wherein the bail receiving member is a generally planar member that is removed from and generally parallel to the container side wall.

13. The container of claim 12 wherein the bail receiving member is removed from the side wall a distance defined by the radially extending flanges.

14. The container of claim 13 wherein the bail receiving member defines an aperture therethrough for receipt of an end of the bail member.

15. The container of claim 11 wherein the rounded bends extend the length of the connecting walls.

16. The pail of claim 11, wherein the recess is substantially V-shaped.

17. The container of claim 11 wherein an interior area defined by the bail ears is sufficiently large enough to permit a portion of one of the connectors to freely pivot therein.

18. The container of claim 11 wherein the gripping portion, the side portions and the end portions together define continuous linear segments of the bail member.

* * * * *